US006035800A

United States Patent [19]

Clifford

[11] Patent Number: 6,035,800

[45] Date of Patent: Mar. 14, 2000

[54] GUNWALE ATTACHABLE DRY BOX FOR SMALL WATERCRAFT

[76] Inventor: Peter A. Clifford, 640 Unity Rd., Benton, Me. 04927

[21] Appl. No.: 09/066,730

[22] Filed: Apr. 25, 1998

Related U.S. Application Data

[60] Provisional application No. 60/044,998, Apr. 28, 1997.

[51] Int. Cl.[7] ..... B63B 17/00

[52] U.S. Cl. ..... 114/347; 114/364

[58] Field of Search ..... 114/343, 347, 114/361, 364

[56] References Cited

U.S. PATENT DOCUMENTS

| | | | |
|---|---|---|---|
| 1,172,974 | 2/1916 | Frayser . | |
| 2,544,599 | 3/1951 | Keelen . | |
| 3,958,289 | 5/1976 | Carlson | 114/347 |
| 4,146,279 | 3/1979 | Stahel . | |
| 4,398,488 | 8/1983 | Mathieu | 114/343 |
| 4,503,799 | 3/1985 | Masters | 114/363 |
| 4,593,642 | 6/1986 | Shay | 114/347 |
| 4,724,791 | 2/1988 | McSorley | 114/343 |
| 5,050,526 | 9/1991 | Nelson et al. | 114/364 |
| 5,662,061 | 9/1997 | Salathe | 114/347 |

*Primary Examiner*—Stephen Avila
*Attorney, Agent, or Firm*—Stan Jones, Patents

[57] ABSTRACT

A dry storage box is held by a clamping device at a longitudinal location along the length of the small watercraft. Dry box provides water tight storage compartment with a hinged lid and latches for storing miscellaneous personal valuables and belongings. The clamped water tight box, in the event of capsize, remains secured to the gunwale, and thus valuables and belongings remain safe, dry and in one location. Incidentally provided are added buoyancy to the vessel in the event of a capsized condition, and when box is in normal use the longitudinal location allows free movement of the occupants about the small watercraft.

18 Claims, 6 Drawing Sheets

(DETAIL)

GUNWALE ATTACHABLE DRY BOX FOR SMALL WATERCRAFT

PREVIOUS FILING INFORMATION

On Apr. 28, 1997 the United States Patent Office received a copy of, and assigned Ser. No. 60/044,998 to, a Provisional Patent Application (PPA) filed by the same inventor hereof. Filed within one year, that PPA is incorporated herein and is being supplemented by this Regular Patent Application (RPA). Applicant expressly reserves all rights and privileges flowing from the PPA and its earlier official filing date and contents thereof.

BACKGROUND OF THE INVENTION

1. Field of the Invention

The field of this invention relates to a dry storage box that removably attaches to a single gunwale of a canoe or similar small watercraft.

Such a storage box also relates to the field of dry storage of valuables in or around small watercraft in which the dry box is detachably supported.

Further, the field of the invention relates to a submersible, water tight storage box having a hinged lid which may, during normal use, be opened and closed while attached to the watercraft.

2. Description of Prior Art

Anyone who enjoys usage of small watercraft, such as canoes or the like, always faces a problem with what to do with belongings that are important to the user. Such valuables are either too important—and should not be left in the vehicle that brought the craft to the body of water—or are essential to full enjoyment of the craft. Accordingly, such valuables are generally placed in shoes, wrapped in towels or stowed in picnic or fishing baskets, knapsacks, camera cases or the like.

In the event of such a small watercraft capsizing, chaos usually erupts. Belongings such as cameras, binoculars, jewelry, wallets, purses, maps and other similar items are at risk. All of the contents in such small craft generally sink to the bottom or are rapidly dispersed by fast moving water where they can not be reclaimed. Collection of such dispersed items is always difficult and sometimes impossible. Tethering of some such articles is sometimes a possibility, but such tethering brings with it the fear of entanglement and otherwise interferes with the full enjoyment of an outing.

This "belongings" problem has faced outdoors men for decades, but until this invention a feasible and ready solution just had not been found. A search of the prior art has revealed various patents, several of which are only of peripheral relevance and others that are greatly disadvantageous when compared to the unusual benefits of the subject invention.

The searcher turned up several patents of interest for review. Included are the following patents:

| | | |
|---|---|---|
| 1,172,974 | Frayser | February 22, 1916 |
| 2,544,599 | Keelen | March 6, 1951 |
| 3,958,289 | Carlson | May 25, 1976 |
| 4,146,279 | Stahel | March 27, 1979 |
| 4,398,488 | Mathieu | August 16, 1983 |
| 4,503,799 | Masters | March 12, 1985 |
| 4,593,642 | Shay | June 10, 1986 |
| 4,724,791 | McSorley | February 16, 1988 |

A brief discussion of this art follows:

1. U.S. Pat. No. 4,398,488 to Mathieu on Aug. 16, 1983.

Mathieu discloses a removable, canoe-carried cooler with a hinged lid. Mathieu discloses an insulated cooler and functions in a transverse position in the canoe when in use, therefore consuming much usable deck space and creating an obstacle when moving about in the canoe. The Mathieu cooler must be wedged into place to secure the device to the canoe, and this wedging is highly impractical due to interference with structural components such as thwarts and seats—often of varying dimensions from craft to craft. Additionally, the cooler and may work itself loose. Neither the clamping method, the longitudinal positioning nor the placement on a single gunwale of the present invention are suggested by this Mathieu reference.

2. U.S. Pat. No. 4,593,642 to Shay on Jun. 10, 1986.

Shay discloses a watertight carrying case that straddles, and is supported by the center thwart of a canoe. As such, the Shay device is held in place by four latching devices that attach to the outside of the gunwales on both sides of the canoe. Shay relies upon the center thwart for support as well as both sides of the canoe for securing the carrying case. The device of the Shay disclosure is designed for very large volume and has a plurality of compartments separated by design due its reliance upon the center thwart for support.

The Shay disclosure—like that of Mathieu—requires a transverse positioning in the canoe when in use. A transverse position requires consumption of valuable deck space and creates an obstacle when one seeks to move the canoe, or when carrying passengers. Shay does not suggest the use of a single gunwale, longitudinal positioning, or an adjustable clamping device that allows positioning of the device to take place on either side of a canoe and in any desirable location upon either side. Shay simply discloses four devices that adjust such that both gunwales of the canoe are attempted to be pulled toward each other in an inward direction. The Shay case is restricted to use in a canoe only and is not suitable for other small watercraft such as a small boat due to the reliance upon a center thwart support.

3. U.S. Pat. No. 3,958,289 to Carlson on May 25, 1976.

Carlson discloses a securing method at four points that requires adjustment and alignment with respect to the top and bottom surfaces of the rail on the gunwale of both sides. The Carlson device is secured into place by a vertical clamping action of clips when a wing nut is turned. Like that of Shay and Mathieu, the Carlson disclosure does not suggest the use of a single gunwale or longitudinal positioning. Instead like the other art, Carlson requires that the compartment be placed in a transverse position requiring the use of gunwales on both sides of the craft. Thus, Carlson also consumes valuable deck space and creates an obstacle when one seeks to move in the canoe or like craft.

4. U.S. Pat. No. 1,172,974 to Frayser on Feb. 22, 1916; U.S. Pat. No. 4,146,279 to Stahel on Mar. 27, 1979 and U.S. Pat. No. 4,503,799 to Masters on Mar. 12, 1985.

Frayser, Masters and Stahel are of even less significance than the references of Mathieu, Shay and Carlson. Frayser and Masters disclose a flotation storage for boats that relies upon being wedged into the bow or stern areas of a canoe and secured in place in a permanent fashion using brackets. Stahel discloses a cooler device that has a plurality of compartments with pivotal doors. Stahel disclose a device that is placed over an existing bench seat in a small boat. Again, this device is placed in a transverse position in the watercraft and relies upon a seating structure to support such positioning. Stahel does not disclose use by securing to a single gunwale, a clamping device, or longitudinal positioning as does the present invention.

5. U.S. Pat. No. 2,544,599 to Keelen on Mar. 6, 1951

Keelen discloses a rowboat safety pontoon. Although the Keelen invention may be detachably affixed to the outside of a small boat in a longitudinal direction, Keelen does not disclose a watertight storage compartment that is placed on the interior side of the watercraft for the storage of valuables and personal possessions. The Keelen disclosure is simply a pontoon held in place by a bracket that is placed on the under side of the boat and requires a clamping method that pulls the pontoon in an upward direction.

6. U.S. Pat. No. 4,724,791 to McSorley on Feb. 16, 1988.

McSorley discloses a marine power cord storage device that is removably mounted to a railing or bulkhead structure on a large cruise or marine personnel type ship. The McSorley device is made of a collapsible canvas-like material that is held into place with the aid of customized brackets and or the looped storage material itself together with associated snapping devices. McSorley does not disclose a hinged watertight dry box for the use of storing valuables and personal belongings nor is it removably attached and detached at will by a clamping device affixing it to the gunwale of a canoe or small boat.

SUMMARY OF THE INVENTION

Disclosed and claimed herein is an attachable/detachable dry storage box for interior and longitudinal attachment on the gunwale of a canoe and/or small boat. By longitudinal is meant the lengthwise direction of the canoe. Likewise the storage box is relatively thin and the longer lengthwise direction of the box runs along the longitudinal direction of the canoe.

Among the key elements in this dry box invention are included, a clamping device that allows the invention to be applied to a single gunwale at most any desired longitudinal location throughout the length of the small watercraft canoe or the like. The dry box consists of a water tight storage compartment with a hinged lid and latching device(s) for storing miscellaneous personal valuables and belongings such as cameras, binoculars, jewelry, wallet, maps and similar items. The clamping device allows the water tight box to be located on the gunwale in close proximity to the occupants for ready access to the stowed items. In the event of a capsize, the clamped storage box remains secured to the gunwale, and thus valuables and belongings remain safe, dry and in one location. The invention also incidentally provides added buoyancy to the vessel in the event of a capsized condition, and when the dry box is in normal use the longitudinal location allows free movement of the occupants about the small watercraft.

OBJECTS OF THE INVENTION

It is an object of the invention to allow for a dry storage box that contains a removable attachment/detachment device(s).

It is another object of the attachable/detachable dry storage box invention to provide both adjustable and removable attachment device(s).

It is another object of the invention to provide for a dry storage box that removably attaches to a single gunwale of a canoe or small boat.

It is yet another object of the invention to provide an attachable dry storage box that remains secured to a longitudinal gunwale of a small water vessel in a capsized condition.

It is a further object of the attachable dry storage box invention to provide additional buoyancy to a vessel in a capsized condition.

It is yet one further object of the invention to provide a dry storage box capable or receiving, containing and storing small belongings miscellaneous in an easily accessed—yet watertight container.

It is still one further object of the attachable dry storage box invention that it contains a hinged lid that provides ready access during the attached condition for such box.

It is another additional object of the attachable dry storage box invention that a hinged lid may readily be opened and closed while the box is attached to the gunwale by securing latches.

It is still one further object of the attachable dry storage box invention to be placed in a longitudinal direction on a single gunwale where the box allows freedom of movement for the users of the canoe or small water craft.

It is an object of the attachable dry storage box invention to be attached at a convenient location throughout most of the length of either gunwale.

It is an object of the invention to provide an attachable dry storage box that is made of a durable material.

It is an object of the invention to provide an attachable dry storage box that is made of a lightweight material having integral therewith both an attachment and a hinged lid structure.

It is a final object of the invention to provide an attachable dry storage box that is capable of being mass produced.

DETAILED DESCRIPTION OF THE DRAWINGS

Figure 1:
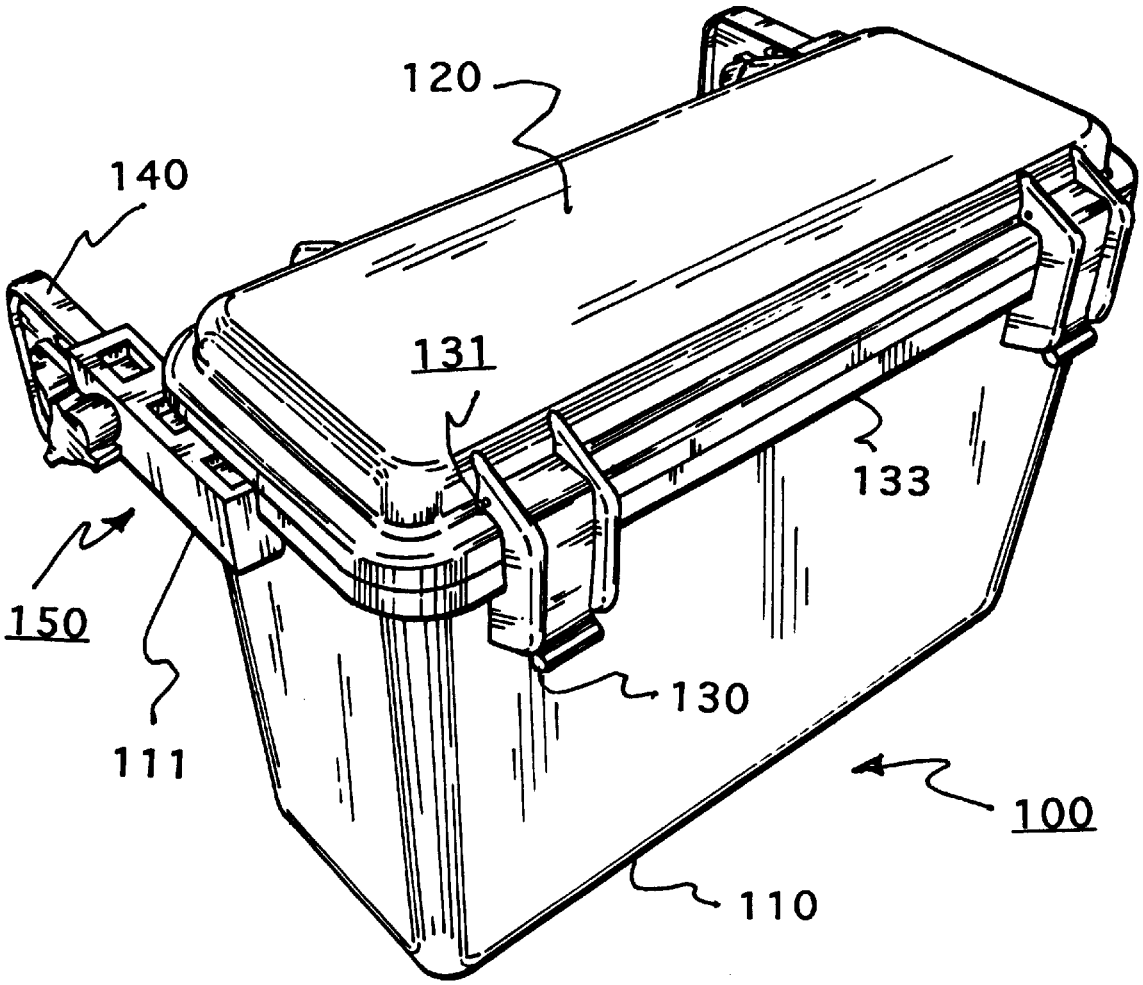
FIG. 1 shows a perspective view of the invention in one preferred embodiment.

On Apr. 28, 1997 the United States Patent Office received a copy of a Provisional Patent Application (PPA) filed by the same inventor hereof and assigned Ser. No. 60/044,998. That PPA is hereby supplemented within one year by the filing of this Regular Patent Application (RPA). The PPA includes FIGS. 1 through 8—many of which are expressly incorporated herein (see FIGS. 5 through 11) by being set forth again in the drawing of this RPA. This RPA additionally includes newly presented FIGS. 1 through 4 which reflect a commercially perfected embodiment of the features of my PPA.

The PPA included the following description concerning the Figures therein presented (with certain grammatical corrections included, some duplicated material omitted for sake of brevity, and RPA FIGS. noted for sake of consistency). That PPA and its filing date is relied upon in full for support of what was there presented.

My PPA—in material respect—is as follows:

Summary: A storage apparatus such as a box or container that is attachable to and capable of being secured to the gunwale of a watercraft such as a canoe or boat for storing one's belongings such as a wallet, gloves, camera or any number of items and/or valuables. The device allows storage of items in one convenient place in an organized manner as well as a safe place for valuable items to remain dry and intact with the watercraft in the event of a capsize. The device is in the form of a box or container that has a top such as a lid that is preferably watertight and is provided with a latching mechanism. The device has protruding brackets that are to be placed over a gunwale to support the entire device and a method of securing the device into a desired interior location upon the gunwale. The box or container may be capable of being compartmentalized. The device is convenient and very easily attached and/or detached from the gunwale of a watercraft.

Abstract: A storage device such as a box or container that is constructed such that it may be suspended from a watercraft's gunwale and secured at any desirable location. The device has a lid that is preferably watertight with a latching capability. The storage device may be capable of being compartmentalized for the purpose of separating and organizing of contents. The gunwale storage device is capable of being placed on a wide range of gunwale shapes and sizes. The device is quick and easy to use for the purpose of organizing belongings as well as providing a safe dry place that will remain with the watercraft in the event of a capsize.

Related Art: Other inventions such as that of Shay, U.S. Pat. No. 4,593,642, Carrying Case For Canoe; Carlson, U.S. Pat. No. 3,958,289, Canoe Storage Compartment; and Mathieu, U.S. Pat. No. 4,398,488, Removable Canoe-Carried Cooler have merely touched upon carrying and storage within a canoe. The above mentioned patents all are devices that are for use with a canoe only and must be placed in a thwart direction across the vessel. Each of the above mentioned inventions are bulky, creating an obstruction for moving about within the vessel and decreasing the available space that may be needed for passengers. The Shay device must be used with a canoe due to the requirement of placement over a thwart and is fixed in width. The Mathieu invention does not adjust in width and relies on a wedging effect to secure the device in place. This is cumbersome and the wedging effect is greatly interfered with by structural devices such as a thwart or seat. All of the above mentioned inventions are cumbersome, of complicated construction, expensive to manufacture and applicable to only a canoe and not to an open hull boat. The gunwale attachable storage device of this invention is quick and easy to use, may be placed at any location throughout the length of the vessel, is out of the way eliminating restricted access, saves deck space for passengers, remains attached to the vessel if capsized, is durable, and is not limited to the use within a canoe only, but also with boats and other watercraft and is capable of being mass produced.

(Cited Problems): When using watercraft such as a canoe or a small boat, many items that are taken along, such as a camera, binoculars, wallet, sunglasses etc. tend to get disorganized, in the way, scattered about on the deck at risk of being damaged by splashing water, and lost overboard if capsized. There are dry boxes and carrying case-type bags available that are very bulky, cumbersome to use, are very expensive and require to be located next to a seat or thwart in order to secure the device by means of cording or straps or have a complicated adjustment device to accommodate the width of the vessel. The Gunwale Attachable Storage Device allows a watertight organizing storage device that may be applied at a desirable location throughout the length of the vessel that quickly and easily attaches and secures into place. The device allows inexpensive storage space that is out of the way and does not take up deck space.

Objects. It is an object of the invention to provide a Gunwale Attachable Storage Device that is made of a durable rigid or semi-rigid material that provides a watertight compartment(s) therein which:

Has an attachment(s) allowing the invention to be in a suspended placement over a gunwale.

Has a securing device to hold the invention in place in event of capsize.

Is capable of being located in an out of the way location.

Is quick to use.

Is easy to use.

Provides watertight storage.

Provides a method to organize items.

Prevents the loss of items and/or valuables.

Prevents items from getting damaged.

Is made of a durable rigid or semi-rigid material.

Has a lid with a securing latch.

Is inexpensive to manufacture.

Is compact, saving valuable deck area for passengers moving about.

Does not slide about on the deck.

Accommodates a wide ranges of gunwale shapes and sizes.

Is lightweight.

Detailed Description (relative to: FIGS. of PPA and this RPA)

Figure 2:
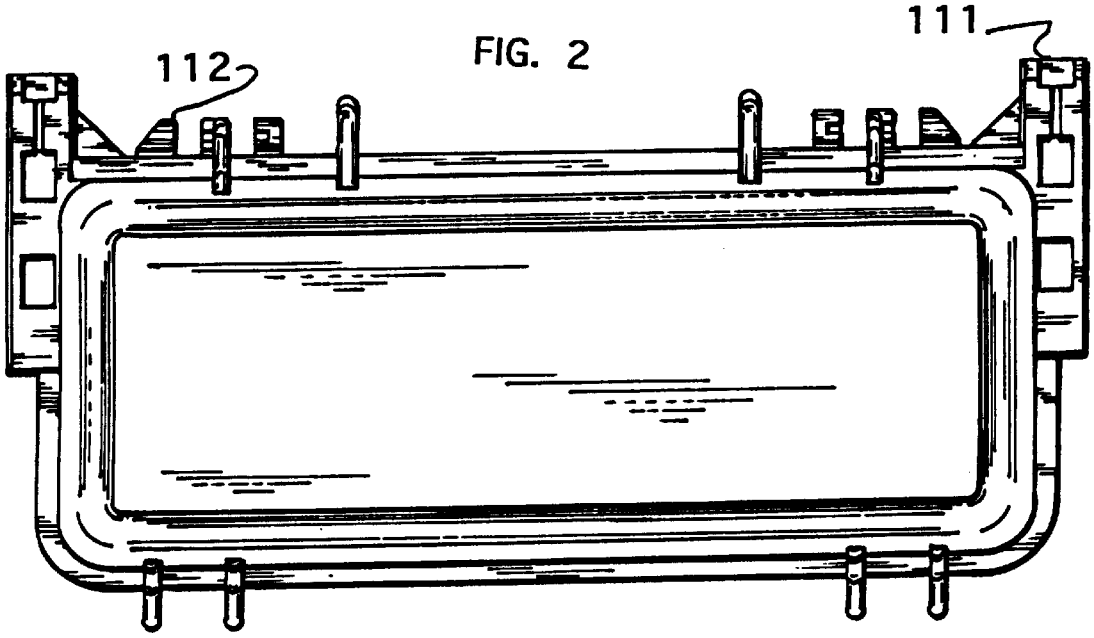
FIG. 2 shows the invention in part in a top view.
Figure 3:
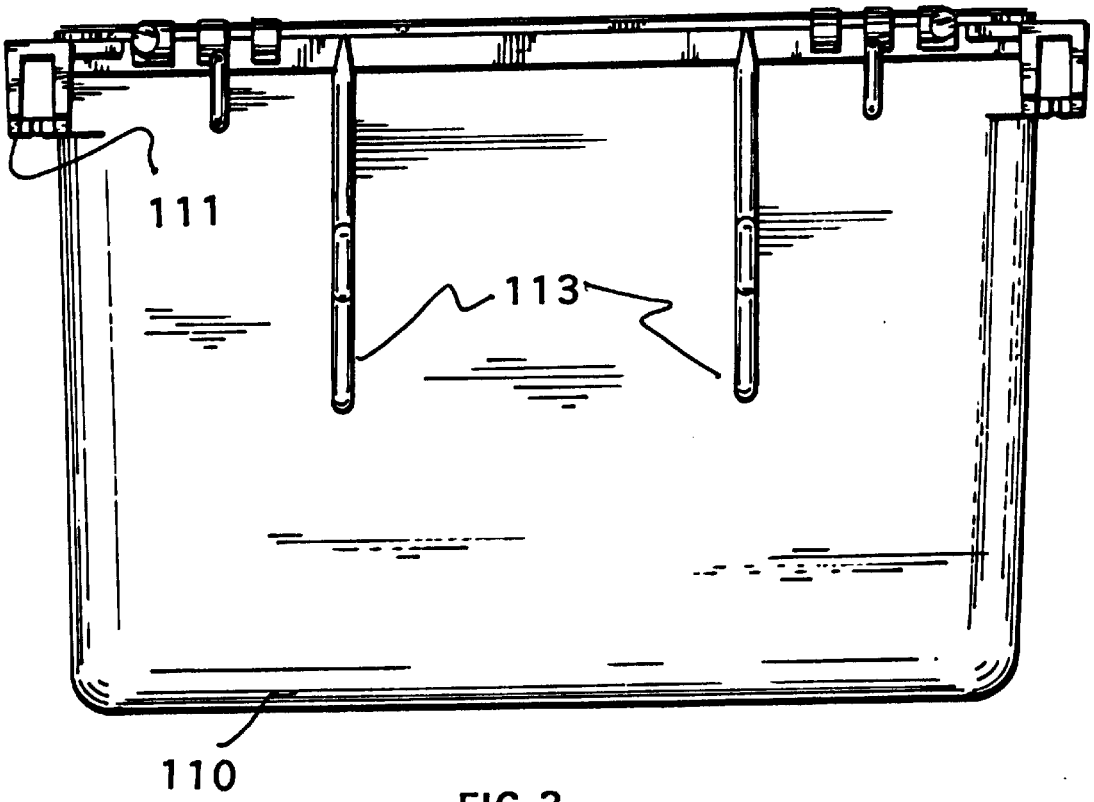
FIG. 3 shows invention in part in a rear view.
Figure 4:
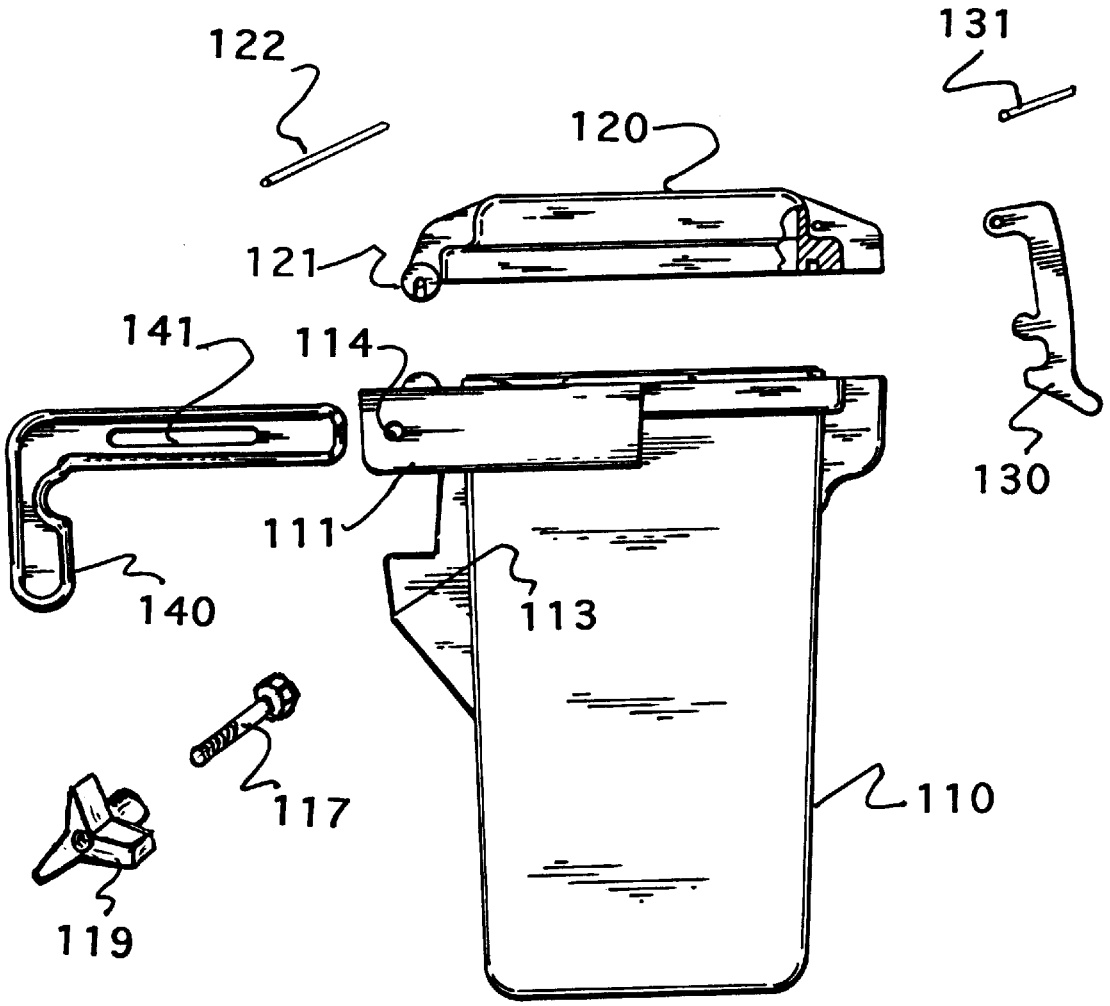
FIG. 4 is a side view of the invention in a disassembled or exploded view.
Figure 5:
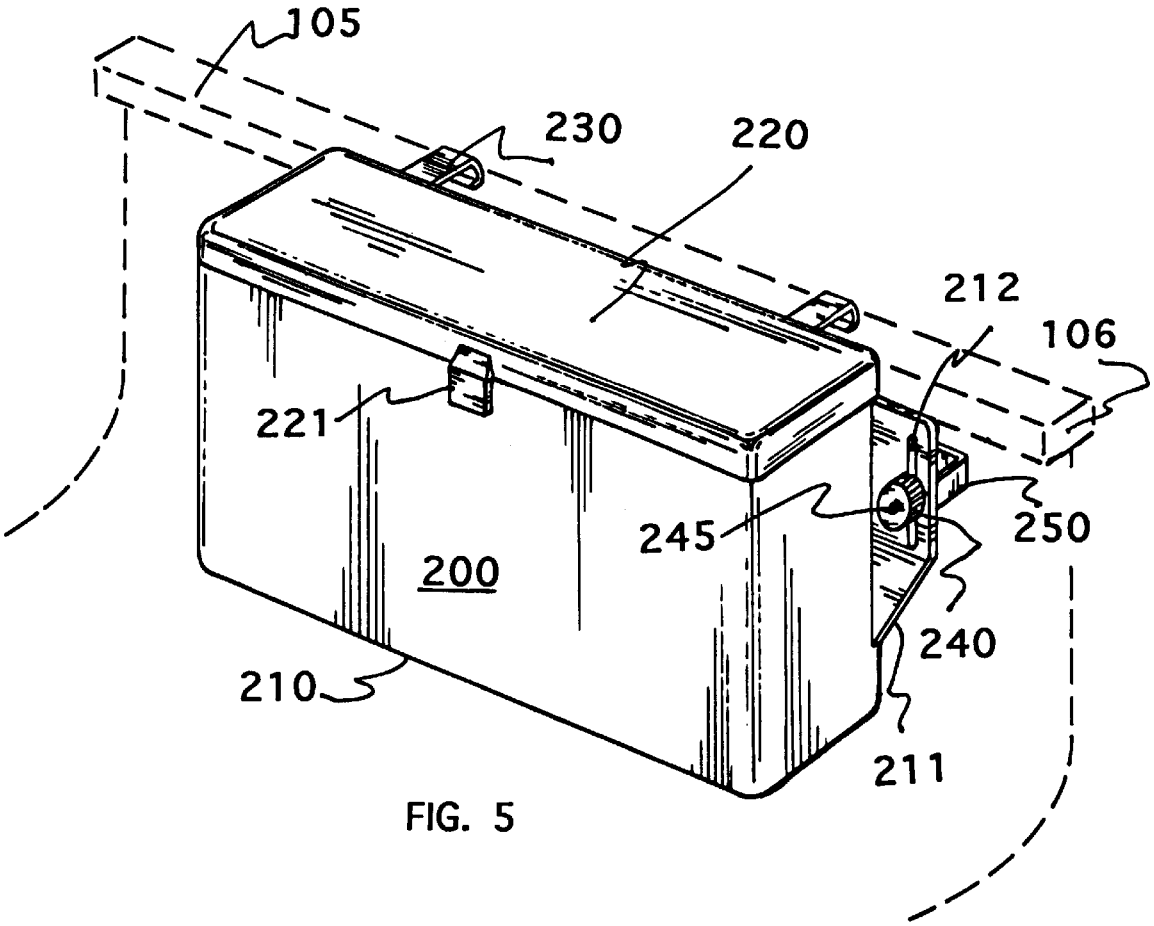
FIG. 5 shows a perspective view of an alternative embodiment of the invention.
Figure 6:
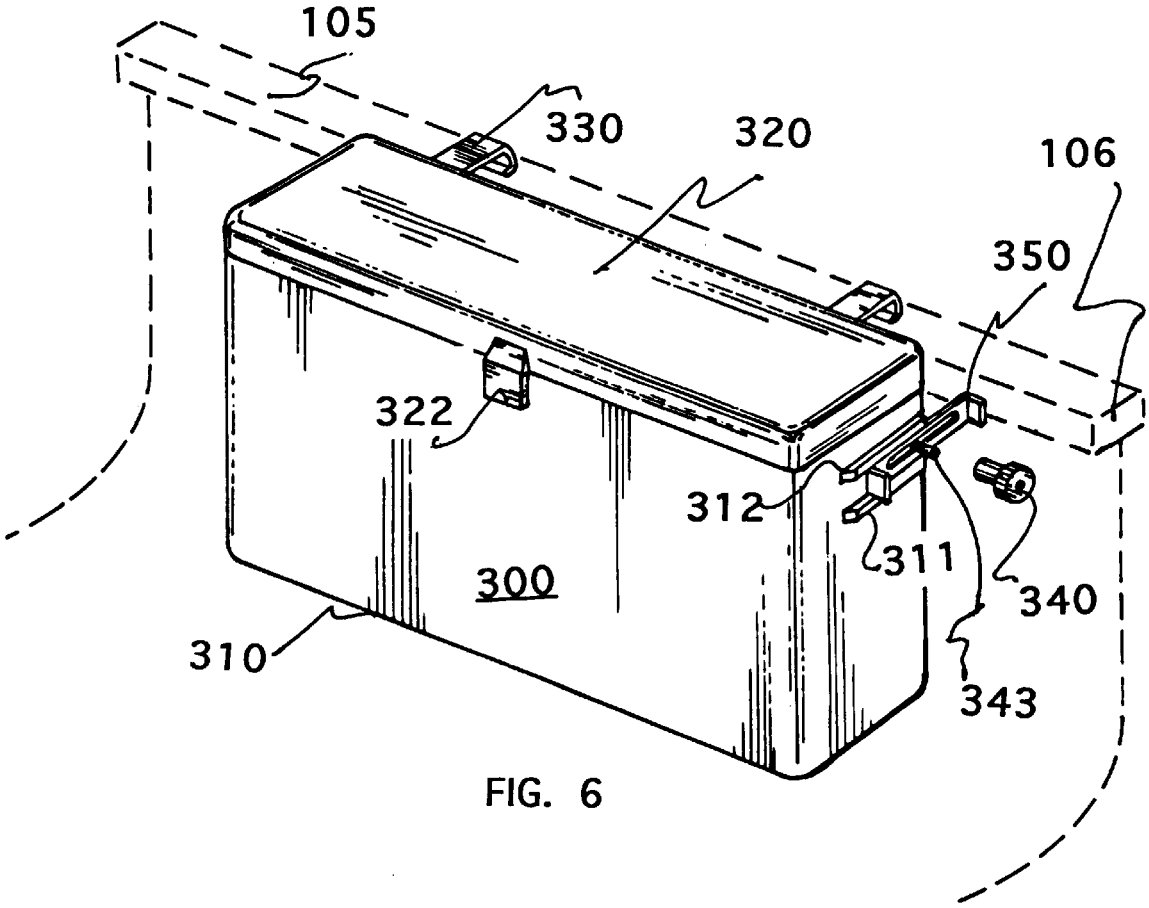
FIG. 6 shows a perspective view of the invention with yet another embodiment with alternative longitudinal attachments for a single gunwale.
Figure 7:
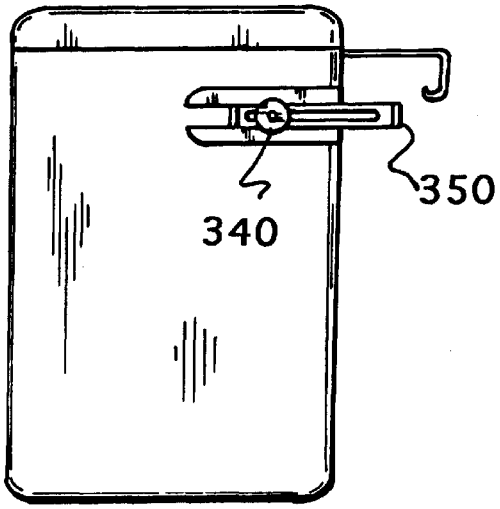
FIG. 7 shows a side view of another embodiment.
Figure 8:
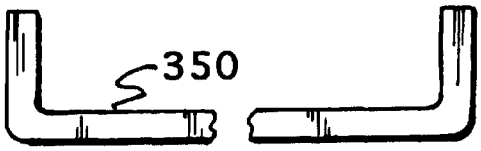
FIGS. 8 and 9 are partial details of the attachment device as shown in FIGS. 6 and 7.
Figure 9:
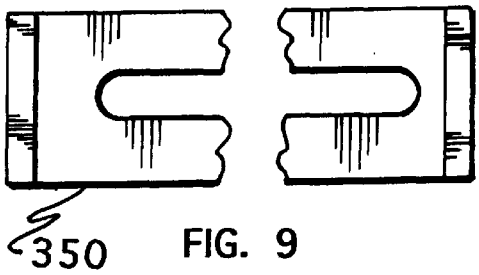

FIG. 1 (PPA—RPA FIG. 5—) is a perspective view of the Gunwale Attachable Storage Device as shown in it's intended use. This embodiment version is preferably made of rigid or semi-rigid material such as plastic which has a protrusion with a slot on each side which allows a vertical adjustment by means of a sliding block that is held in a secured position by means of a threaded knob creating friction upon the box protrusion. FIG. 2 (PPA—RPA FIG. 10—) is a side view of the invention showing the supports that are placed over a vessel's gunwale and the sliding friction mechanism that is used to secure the invention into place. FIG. 3 (PPA) shows a detail of the sliding block preferably of plastic material that would be used with the embodiments as shown in FIGS. 1 and 2 (PPA). FIG. 4 (PPA FIG. 6) is another embodiment that the invention may take shown in it's intended use. This version uses a horizontal sliding mechanism that secures the invention to the gunwale of the vessel. FIG. 5 (PPA—RPA FIG. 7—) is a side view of the invention with the embodiment as shown in FIG. 4. FIG. 6 (PPA—RPA FIG. 11—) is a cross section view of the horizontal sliding mechanism of FIGS. 4 and 5. FIG. 6 (PPA—RPA FIG. 11—) shows an extruded groove that is part of the wall of the box with a through fastener which passes through a slot in a slide device, a washer and a threaded knob. FIG. 7 (PPA—RPA FIGS. 8 and 9—) shows details of the slotted slide device that is preferably made of metal or plastic and is moved horizontally until it rests against the inside gunwale of the vessel and held in place via friction caused by the threaded knob. FIG. 8 (PPA) shows an embodiment of a device that may be attached to an existing container or box for the purpose of suspending it from a gunwale. A front view of FIG. 8 shows a slot in which a sliding securing device is used similar as the device shown in FIGS. 1 and 2. The attachment device shown in FIG. 8 could be made of molded plastic or metal with the suspending arm shaped similar to that shown in the side view of FIG. 8. The attachment device would be attached to an existing box of desired shape and size by fastener devices such as rivets, bolts, and screws. FIG. 9 shows a side view of an attachment device that is attached to an existing box or container of desired shape and size. The device shown in FIG. 9 uses a horizontal sliding mechanism to secure to the vessel's gunwale similar to the device as shown in FIGS. 4, 5 and 7. Many variations of materials and configurations could be used to accomplish the objects of the invention. The descriptions included here could be varied in general and in detail in materials and design to accomplish a desired result.

Turning in detail to the drawings, FIGS. 1 through 4 present a commercialized form of my dry box invention. The attachable dry box 100 may preferably be made of a lightweight and durable plastic which is in molded form. Other suitable materials, of course, such as fiberglass, aluminum, wood or similar material could readily be used without departing from the principles of this invention.

FIG. 1 shows the attachable dry storage box invention 100 in its current preferred embodiment with like numbers being used in FIGS. 1 through 4. The invention may conveniently be taken, for example, in a vehicle to the marina and various personal and outing items placed in the dry box 100 before departing from the vehicle to the canoe or small water craft.

Upon arriving at the canoe, the dry storage box 100 may be placed on the gunwale of the canoe (or boat). Box 100 is supported, in part, on the top gunwale surface 105, (FIG. 6) by the underside of the clamp receiver(s) 111. The J-shaped sliding clamp(s) 140 are capable of being moved inboard or outboard by a sliding action in the mating receiving slot in receiver 111 before tightening in place. Such adjustability accommodates installation and adaptability from craft to craft for various sized gunwales.

Once the dry box invention is in place and the sliding clamp 140 is snugged up firmly against an outer surface of the gunwale, the device is locked into place by the turning of the locking knob assembly 150. The locking device 150, as best shown in exploded view in FIG. 4, functions with a threaded through bolt 117 inserted through a hole 114 in the receiver 111 and passing through a slot 141 in the sliding J-shaped clamp 140.

Knob 119, with the bolt 117 threads inserted into the mating threads within locking knob 119, may be tightened to secure the dry box 100 to the gunwale 106. When locking knob 119 is tightened, receiver 111 binds against the sliding J-shaped clamp 140 and holds it in place with friction. At that point the dry box 100 is securely fastened in a longitudinal position against the gunwale 105. Since it fits snugly against the interior side of the canoe, box 100 does not present an obstacle to passenger movement during the outing; and, better yet, box 100 provides a safe and dry storage location for valuables that otherwise were previously at risk during the canoe trip.

In FIG. 1 the hinged lid 120 is shown in a closed position with the securing latches 130 latched in place against an outstanding lip 133. Latches 130 both pivot about a hinge pin 131, FIG. 4, that is positioned by webs molded or otherwise integrally formed with the lid 120.

FIG. 2 shows a top view of the water tight compartment 110 with the invention in a partially assembled condition. The top view shows how the receivers 111 are slotted in order to allow sufficient flexibility for binding against the J-Shaped clamp 140 when clamped as described above. A portion of the rear hinge assembly 112 for lid 120 is also shown in FIG. 2. These hinges 112 are located at the rear on both ends of the compartment 110.

FIG. 3 is a rear view of the water tight compartment 110. The securing fins 113, as shown, are notched to fit under the inside of a gunwale 106 and serve to eliminate any inadvertent removal of the invention from a gunwale. The shape of fins 113 accommodates the interior shape of a canoe and allows a snug—yet tight fit—against the canoe side.

FIG. 4 is an exploded view showing the components of the preferred embodiment of the invention. The water tight compartment 110 with securing fins 113, receiver 111 and J-shaped clamp 140 are arranged to essentially surround a gunwale and thus eliminate any chance of inadvertent removal by various directional forces. The J-shaped clamp 140 is inserted into the receiver 111 and bolt 117 is, in turn, inserted through hole 114, slot 141 and into locking knob 119. Hinged lid 120 is located on the top of compartment 110 and pivots about the hinge pin 122 and hinge 121. This hinged lid is secured in a closed position via latch 130, which latch, in turn, is secured to the lid 120 via pin 131 so as to allow a pivoting action for the latch 130.

FIG. 5 is an alternative embodiment 200 of the attachable dry box shown in a working position on the gunwale of a canoe. The watertight compartment 210 has integrally or affixed thereto an extension 211 on each end which include a through slot 212. A bolt 245 is inserted through a sliding block 250 and is inserted into a locking knob 240. When assembled, the invention is suspended from a gunwale by brackets 230, which may be fabricated of metal or molded integrally in plastic.

The sliding block 250 is adjusted vertically until contact is made with the underside of the gunwale and held in place by a friction fit established by the knob assembly just described when locking knob 240 is turned in a tightening direction. The hinged lid 220 is attached and secured in a similar method as that of the preferred embodiment.

FIG. 6 is another embodiment of the invention that is suspended in a similar manner to that shown in FIG. 5 but discloses an alternative method for securing the invention to resist inadvertent removal due to vertical forces. The securing mechanism of FIG. 6 consists of two raised guide extrusions 311 and 312 from compartment 310 which form a channel for slidably receiving a slide 350. A threaded stud, or bolt 343, passes through the side of compartment 310 and also passes through the slot in slide mechanism 350 and into a mating threaded portion of a locking knob 340.

When assembled, the slide mechanism 350 moves in a horizontal direction with the slide mechanism itself contacting the inner surface of the gunwale 105 where it is locked into place with the locking knob 340. This locking therefore eliminate inadvertent removal by vertical forces. Such forces might result from movement of an upward foot, leg or the like.

Figure 10:
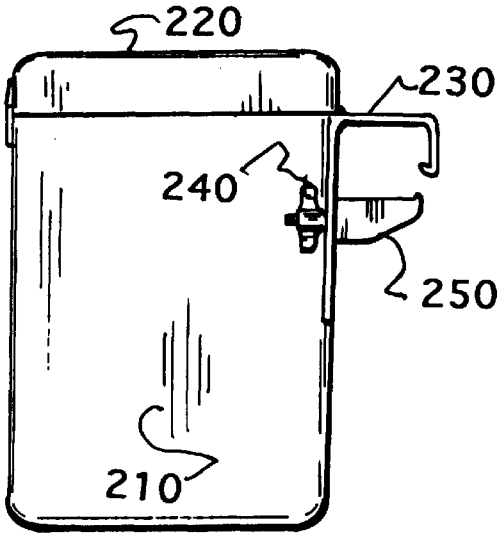
FIG. 10 is a side view of the alternative embodiment show in FIGS. 6 and 7.
Figure 11:
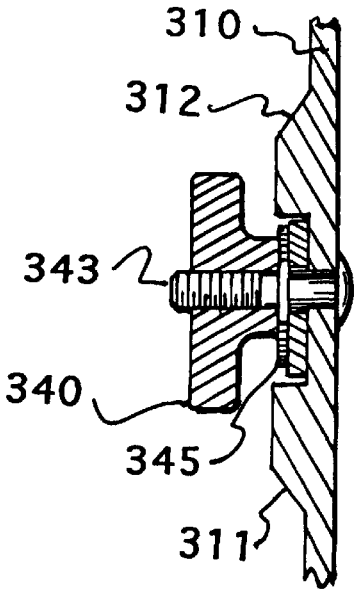
FIG. 11 is a partial cutaway detail drawing for the attachment device of FIG. 10.

FIGS. 7 and 10 are side views showing alternative embodiments as previously discussed and are believed to be self explanatory when considered in light of the earlier description. FIG. 11 is a cross section detail of the horizontal locking device as shown in FIGS. 6 and 7. FIGS. 8 and 9 are detail views of the sliding device 350 as discussed in alternative embodiments of FIGS. 6 and 7.

As can be seen there are several compartmentalized carrying devices for canoes, but this invention provides several significant benefits to the user including security, ready accessibility, reduction of consumption of valuable deck space, ease of use and durability. Numerous additions, modifications and constructions can be performed within the scope of the invention and such scope is to be measured by the claims herein.

While my invention has been described with reference to a particular examples of some preferred embodiments, it is my intention to cover all modifications and equivalents within the scope of the following claims. It is therefore requested that the following claims, which define my invention, be given a liberal interpretation which is within the spirit and scope of securing adequate protection commensurate with my novel contribution to this art.

What is claimed is:

1. An attachable/detachable dry storage box for occupant storage of miscellaneous belongings such as cameras, binoculars, jewelry, wallets, maps and similar items, said storage box comprising:

attachment means for removably securing said box on the interior of, and along, a single longitudinal gunwale of a canoe or small watercraft;

means positioning said box against the interior side of said watercraft such that when the dry box is in normal use the longitudinal location allows unimpeded movement of occupants about the small watercraft:

a hinged lid and a water tight storage compartment within said box; and latching means for securing said lid to said compartment with a water tight seal.

2. A storage box in accordance with claim 1 and, in the event of a capsize of said craft, further comprising:

means associated with said attachment means for assuring said box remains secured to the gunwale in the event of said capsize such that the belongings remain safe, dry and in one location.

3. A storage box in accordance with claim 1 and wherein said latching means further comprises:

hinged latches allowing a user access into said water tight compartment from the inboard side of said gunwale.

4. A storage box in accordance with claim 1 and wherein said box further comprises:

an air tight chamber within said box when closed which air tight box also incidentally provides added buoyancy to the watercraft in the event of a capsized condition.

5. A storage box in accordance with claim 1 and wherein said attachment means for said box further comprises:

an adjustment mechanism which allows said box to be adapted for different sized gunwales; and a locking means for locking said attachment means to said gunwale when fitted thereabout.

6. A storage box in accordance with claim 1 and wherein said attachment means for said box further comprises:

means permitting ready installation and/or removability of said storage box as needed for storage of said belongings.

7. A storage box in accordance with claim 1 and wherein said attachment means for said box further comprises:

a pair of spaced clamping devices adapted with a shape that adjusts for a fit around a single gunwale of said canoe or small boat.

8. A storage box in accordance with claim 1 wherein said adjustment mechanism for said box further comprises:

a J-shaped securing hook having a lower face surface for contact against the top surface of said gunwale and the downward depending leg of said J-shape providing sliding contact against the outboard side of said gunwale; and a receiver for slidably receiving said J-shaped securing hook and binding said hook in place in order to secure said box in position on said longitudinal gunwale.

9. A storage box in accordance with claim 8 wherein said adjustment mechanism for said box further comprises:

slots in said receiver to allow sufficient flexibility in said receiver for binding the J-shaped hook; and a threaded locking bolt/knob assembly for binding said receiver hook in place on said receiver.

10. A storage box in accordance with claim 1 wherein said box is a molded plastic-like material, and said box further comprises:

hinge means forming a molded hinged lid which may be opened and closed at will for access into said water tight storage compartment.

11. A storage box in accordance with claim 10 wherein said latching means for said box is also a molded plastic-like material and further comprises:

hinging means on the outboard side of said box for hingably securing said water tight lid to said compartment with a water tight seal.

12. A storage box in accordance with claim 1 wherein said box is a molded plastic-like material and further comprises:

securing fins notched to fit under the lower side of a gunwale and serving, when said box is secured thereto, to eliminate inadvertent removal of the box from said gunwale.

13. A storage box in accordance with claim 12 wherein said box is a molded plastic-like material and further comprises:

said securing fins and attachment means surround the sides of said gunwale sufficiently to eliminate inadvertent removal of said secured box due to various directional forces.

14. A storage box in accordance with claim 13 wherein said box further comprises:

a slide receiver and J-shaped clamp slidably fitted within said receiver for further surrounding said gunwale and thereby affording further protection against inadvertent removal of said secured box due to various directional forces.

15. A storage box in accordance with claim 14 wherein said box further comprises:

said J-shaped clamp is inserted into the receiver;

a through bolt is inserted through an opening in the receiver and into a locking knob for securing said clamp to said receiver.

16. A storage box in accordance with claim 11 wherein said box further comprises:

said hinged lid being located on the top of said compartment and pivoting about a hinge pin and hinge fastened on said box.

17. A storage box in accordance with claim 16 wherein said box further comprises:

said hinged lid is secured in a open/closed position via a latch, which latch is secured to the lid and allows a pivoting action for the lid.

18. A method of safely storing miscellaneous belongings such as cameras, binoculars, jewelry, wallets, maps and similar items, in a dry box on a canoe or small water craft while protecting said items in the case of said craft capsizing, said method comprising the steps of:

positioning said box against the interior side of said watercraft in a longitudinal location adjacent a gunwale such that when the dry box is in normal use the position allows unimpeded movement of occupants about the small watercraft:

securing said dry box on the interior of, and along, a single longitudinal gunwale of said canoe or small boat;

forming a water tight storage compartment within said box;

hinging a water tight lid on said box for easy user access into said water tight storage compartment during normal use; and fastening said box to said gunwale such that the items remain dry and safe should the craft capsize.

* * * * *